United States Patent [19]

Fowler

[11] 4,260,444

[45] Apr. 7, 1981

[54] METHOD OF PRODUCING FREE-STANDING NEWSPAPER INSERTS WITH A TISSUE SAMPLE ATTACHED

[75] Inventor: Eugene W. Fowler, Sun City, Ariz.

[73] Assignee: Gene Fowler and Friends, Inc., Sun City, Ariz.

[21] Appl. No.: 38,924

[22] Filed: May 14, 1979

[51] Int. Cl.[3] ..... B65D 75/26

[52] U.S. Cl. ..... 156/252; 156/253; 156/267; 156/268; 156/269; 156/271; 156/324; 282/1 R; 282/11.5 R; 282/DIG. 2; 283/1 R; 283/56; 283/59; 283/60 R; 283/61; 283/66 R; 283/66 A

[58] Field of Search ..... 156/252, 253, 268, 269, 156/324, 267, 271; 282/DIG. 2, 1 R, 11.5 R; 283/1 R, 56, 61, 59, 60 R, 66 R, 66 A; 40/2 R, 27, 360

[56] References Cited

U.S. PATENT DOCUMENTS

| | | | |
|---|---|---|---|
| 2,907,585 | 10/1959 | Sornberger et al. | 282/11.5 R |
| 3,320,109 | 5/1967 | Brander | 156/252 |
| 3,503,680 | 4/1970 | Newman | 282/DIG. 2 |
| 3,727,908 | 4/1973 | Whitesell et al. | 156/324 |
| 3,756,889 | 9/1973 | Wolfberg et al. | 156/253 |
| 4,171,831 | 10/1979 | Robinson | 156/252 |

*Primary Examiner*—Caleb Weston

*Attorney, Agent, or Firm*—Kinney, Lange, Braddock, Westman and Fairbairn

[57] ABSTRACT

One of the most effective methods of marketing a new product is to sample it, get it into the hands of millions of prospective customers so they can test it, feel it, taste it or smell it. Product sampling is practiced, however, only when it can be done economically. The present invention relates to the economical sampling of thin absorbent tissues such as toilet tissue, paper toweling, facial tissue and similar thin, lightweight products. The present invention reduces the cost of hand tipping samples of absorbent paper tissues from approximately $60.00 per 1,000 to below $9.00 per 1,000. This 85% reduction in costs will enable tissue producers to sample their products to more consumers so they can test them prior to buying. In the present invention, a printed front cover, the tissue sample or samples, and a printed back cover are delivered to a collator in continuous ribbons. The ribbons are glued together on their "stub edge" so they become a single tissue/sampler, perforated, cut to length and trimmed at speeds ranging from 8,000 to 16,000 tissue/samplers per hour. Several methods of binding tissue/samplers have been developed, including the use of hot and cold glue systems, and spot and strip gluing. The invention is applicable to both coated and uncoated papers for the front and back covers.

9 Claims, 8 Drawing Figures

METHOD OF PRODUCING FREE-STANDING NEWSPAPER INSERTS WITH A TISSUE SAMPLE ATTACHED

BACKGROUND OF INVENTION

1. Field of the Invention

The invention relates to improving methods of introducing samples of tissue products to consumers. It enables tissue manufacturers to present samples of their products (new and old) to consumers so they can test the tissue themselves prior to purchasing it.

In particular, the present invention relates to a free-standing newspaper insert containing a sample or samples of thin, absorbent paper such as toilet tissue, paper toweling and facial tissue.

2. Description of the Prior Art

In the past free-standing advertising inserts have been developed which have been distributed with newspapers. Various types of products including cosmetics, paper products and even razor blades have been sampled using a newspaper insert as the carrier.

To the best of my knowledge two methods have been used in the past to produce newspaper inserts for sampling paper toweling. A first method used in producing inserts for "Bolts" paper toweling of American Can Company, involved the following steps:

1. A four-color folder was printed in large sheets by the sheet fed process. The sheets were cut apart, to size 23"×11-½" and folded to 11-½"×11-½" (four page folders).

2. American Can's Bolt toweling which is produced in jumbo rolls 102" long and 108" in diameter was unwound and cut manually to samples 11"×11".

3. The four-page folders and sample toweling were delivered to a bindery where the folders were opened and the 11"×11" pieces of Bolt were glued to the folders near the center of the top edge. The four-page folder was then refolded.

This procedure proved to be unsatisfactory for several reasons. First, since it requires a significant amount of hand labor, the cost of tipping the samples is prohibitive for quantities of several million. The cost for tipping the toweling samples by this method is about ≠60.00 per 1,000. Second, the manual tipping of samples into the insert is relatively slow and is not well suited to the production of large numbers of advertising inserts. Third, the manual process is inaccurate and unwieldy because of difficulties involved in handling lightweight sheets of tissue and glue. As a result the sample sheets may be skewed in orientation within the folder. This can result in part of the sample sticking outside of the folder and makes the insert less attractive in appearance. Fourth, in the event the manufacturer of the tissue being sampled wants the consumer to test it by washing or wiping a window pane, glue from the glue spot may scratch the window.

A second method was used in producing an insert containing "Job Squad" paper toweling of Scott Paper Company. The insert was apparently produced as follows:

1. The four-color folder was printed via web offset to size 17"×11-⅜". It was then folded to 10-¾"×11-⅜".

2. The Job Squad toweling was manually cut to 10"×11-⅛" as was done per step 2 of the first method.

3. The four-page folders and sample toweling was obviously delivered to a company that specializes in tipping products because this is apparent from the attached sample. Here the sample toweling was glued into the folder with a glue strip about 4-½" long. As is the case with the first method, the four-page folder had to be opened to glue in the toweling sample and then closed.

This second method also is unsatisfactory. First, the sample toweling extends ⅛"past the trimmed right hand side of the four-page folder and is not attractive. Second, when the sample of toweling is removed, it can have an unattractive upper left hand corner which can have small pieces of coarse glue. Third, although the second method is more mechanized, the printing and tipping operations obviously have to be done in two plant locations.

"Collators" have been used for many years to produce unit set business forms with a carbon paper layer between original and duplicate copy layers. In the past, however, collators have not been used in the production of advertising inserts for absorbent paper tissue products such as toilet tissue, paper toweling, or facial tissue.

SUMMARY OF THE INVENTION

The present invention is a free-standing newspaper insert which contains a sample sheet of a thin paper product such as a paper towel, facial tissue, or toilet tissue attached along the stub edge between the front and back cover sheets. The present invention permits high speed, low cost production of advertising inserts which are consistent in quality and do not suffer from the problems associated with the prior art newspaper inserts of these types of products.

With the present invention, the front and back covers, together with a ribbon (web) of the thin absorbent material being sampled are fed to the collator from three or six paper roll spindles on the collator.

Prior to being placed on the roll spindler, the front and back covers have been lithographed with the advertiser's message, pinholes which regulate register in collating have been punched on the rotary press and the covers are wound preferably onto 39" diameter rolls with 3" diameter disposable cores. The front covers are on one roll. The back covers are on a second roll.

The paper toweling also is furnished to the roll spindles preferably on 39" diameter rolls with 3" diameter disposable cores. These rolls are slit and rewound from jumbo production rolls which measure 102" in width and 108" in diameter. This is a mechanized procedure which eliminates the slow costly procedure for manually cutting individual samples of tissue as required in the prior art. No transverse perforating typical of power toweling or toilet tissue is required.

With the front and back covers and the tissue on the paper roll spindles the three webs are collated. The pinholes on the front and back covers keep these in register. The tissue requires no register because it carries no printed message.

As the three webs pass through the collator they are bonded longitudinally along the stub edge. The tissue sample is bonded between the two front and back cover webs so that the front and back covers are attached together and the tissue sample is bonded to the inside of the back cover.

After the three webs have been bonded together (the front and back covers and the tissue sample) they are all perforated longitudinally (with the flow of the press), the unattractive stub with pinholes is trimmed off and the web is cut into the finished tissue/samplers.

DETAILED DESCRIPTION OF THE PREFERRED EMBODIMENTS

Figure 1:
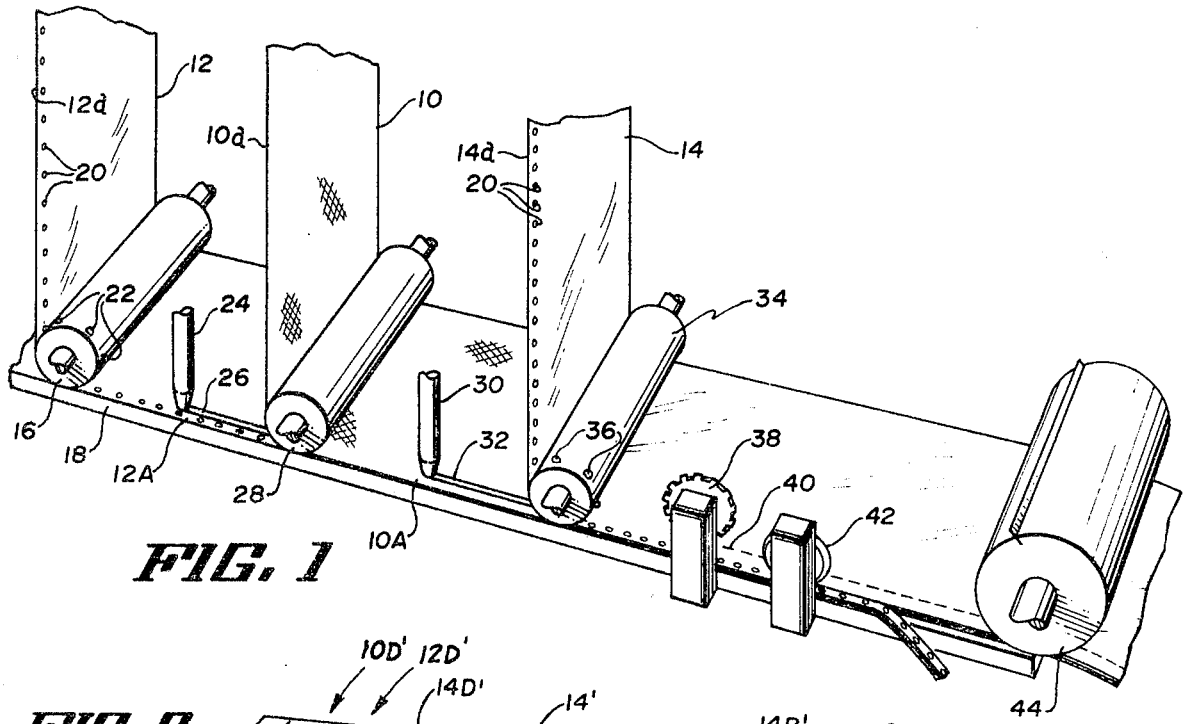
FIG. 1 shows the production of the tissue/sampler for newspapers according to the method of the present invention.

FIG. 1 schematically illustrates one preferred method of producing advertising inserts for newspapers in accordance with the present invention. As illustrated in FIG. 1, a roll of thin absorbent paper tissue 10 is supplied, together with the first and second cover ribbons 12 and 14. Printed cover ribbons 12 and 14 typically have printed advertising and information regarding the thin absorbent paper tissue 10. Strip 10 is preferably a paper towel, facial tissue, or toilet tissue ribbon which is supplied from a large roll or web (not shown). In the preferred embodiments, ribbon 10 preferably does not contain transverse perforations as is typical with paper toweling and with toilet tissue.

As described previously, the paper tissue forming sample ribbon 10 is typically made by the manufacturer on jumbo-size production rolls of 102" width and 108" diameter. Sample ribbon 10 is produced by slitting the paper tissue longitudinally to the desired sample ribbon width (e.g. 11") and rewinding the ribbon onto a 39" diameter roll with a 3" diameter disposable core. Sample ribbon 10 is then supplied from this second roll (not shown). This mechanized procedure eliminates the slow and costly procedure used to produce prior art newspaper inserts, which involved manually cutting individual samples of tissue.

First cover ribbon 12 is supplied under roller 16 and onto base plate 18. Located along first edge 12A of ribbon 12 are longitudinally spaced line holes 20. These line holes permit proper alignment of ribbon 12 with respect to ribbon 14, so that the printed material on the two cover ribbons will be properly aligned. Teeth 22 on roller 16 engage the line holes of ribbon 12 to assure synchronized feeding.

First adhesive applying nozzle 24 applies a thin strip 26 of adhesive parallel to first edge 12A of strip 12. Glue strip 26 is located on the opposite side of line holes 20 from first edge 12A.

Sample ribbon 10 is supplied under roller 28 so that it overlays first cover ribbon 12. First edge 10A of ribbon 10 is aligned and parallel to edge 12A of ribbon 12, but is spaced slightly inside of edge 12A so that line holes 20 of ribbon 12 remain exposed. Ribbon 10 is bonded to cover ribbon 12 by adhesive strip 26.

Second adhesive nozzle 30 applies a second adhesive strip 32 on the top surface of ribbon 10 and parallel to first edge 10A (stud edge) of ribbon 10. This second adhesive strip 32 bonds second cover ribbon 14 to sample ribbon 10 when second cover ribbon 14 is supplied under roller 34.

As in the case of first cover ribbon 12, second cover ribbon 14 has line holes 20 which are used for aligning second cover ribbon 14 with respect to first cover ribbon 12. Teeth 36 of roller 34 engage the line holes 20. The first edge 14A of sheet 14 is aligned with the first edge 12A of strip 12.

The next step of the method after sample ribbon 10 has been bonded between cover ribbons 12 and 14 is to produce a longitudinal perforation parallel to the first (stub) edges of the ribbons. Perforation wheel 38 produces these perforations, which are spaced from the first (stub) edges. In the perferred embodiment, perforations 40 are spaced sufficiently from the first edges so that they are on opposite side of adhesive strips 26 and 32 from the first (stub) edges. This permits easy removal of a sample sheet from the finished newspaper insert.

Since the line holes detract from the overall effect of the advertising insert, trimmer 42 trims the line hole bearing portions from ribbons 12 and 14. The adhesive strips 26 and 32 are positioned so that they are not removed by trimmer 42, and the ribbons 10, 12 and 14 remain bonded together.

Finally, knife 44 cuts individual bonded inserts from the ribbon. The operation of knife 44 is timed so that advertising inserts of uniform width are cut from the bonded ribbon.

The tissue/sampler can be varied in size to meet the tissue producer's requirements. The length is variable—up to 24". The stub edge typically has one of the following widths.

| | | |
|---|---|---|
| 3.4" | $5\frac{5}{8}$" | 14" |
| $3\frac{1}{2}$" | 7" | 17" |
| $3\frac{5}{8}$" | $7\frac{1}{3}$" | 22" |
| $4\frac{1}{4}$" | $8\frac{1}{2}$" | 28" |
| $5\frac{1}{2}$" | 11" | |

Figure 2:
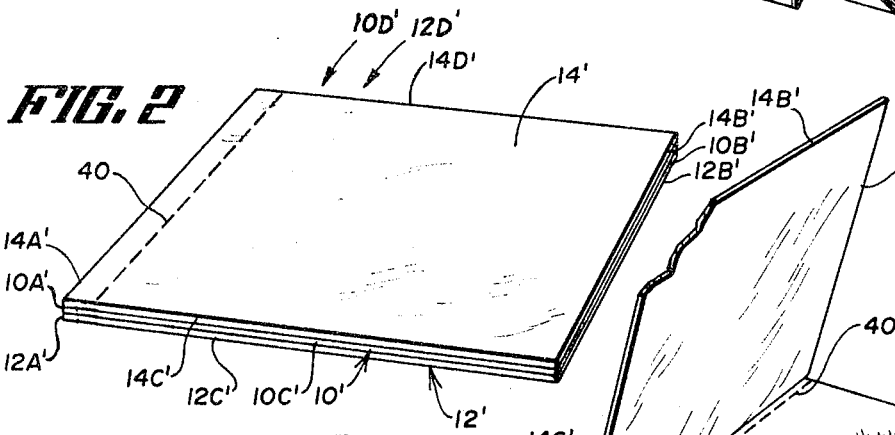
FIGS. 2 and 3 show an advertising insert of the present invention, as produced by the method illustrated in FIG. 1.
Figure 3:
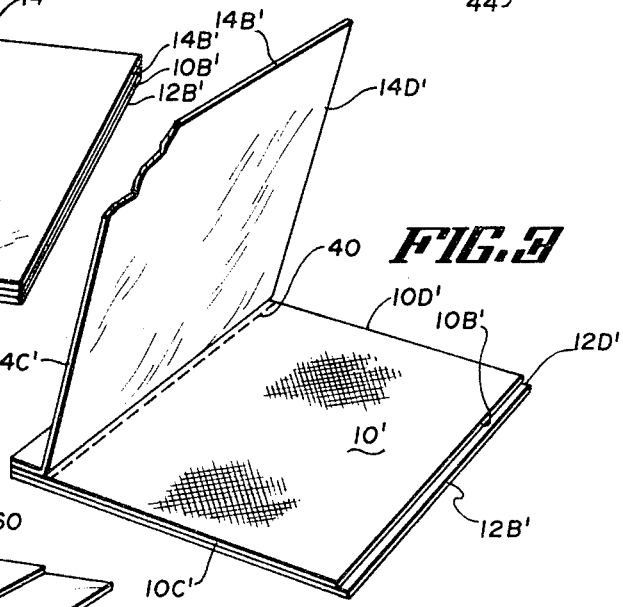

FIGS. 2 and 3 show an example of an advertising insert produced by the method illustrated in FIG. 1. In the embodiment shown in FIGS. 2 and 3, top sheet 14' and bottom cover sheet 12' form a folder with sample sheet 10' attached therebetween. The first edges 10A', 12A', and 14A' are closely aligned. As illustrated in the method shown in FIG. 1, sheet 10' is bonded to sheet 12' by a first adhesive strip and to sheet 14' by a second adhesive strip. Perforation 40 extends parallel to first edges 10A', 12A', and 14A'. The adhesive strips (no shown in FIGS. 2 and 3) are located between perforations 40 and first (stub) edges 10A', 12A', and 14A'. As a result, sample sheet 10A may be easily removed from the insert by tearing along perforation 40. As also illustrated in FIGS. 2 and 3, the second edges 10B', 12B', and 14B' are all aligned parallel to one another due to the alignment of first stub edges 10A', 12A', and 14A'. In addition, the third edges 10C', 12C', and 14C', and the fourth edges 10D', 12D', and 14D' are all exactly aligned. This alignment is the result of the transverse cutting of knife 44. As illustrated in FIGS. 2 and 3, the precise alignment of the edges makes an extremely attractive package. The sample is not skewed with respect to the cover sheets, and yet is easy to remove.

Figure 4:
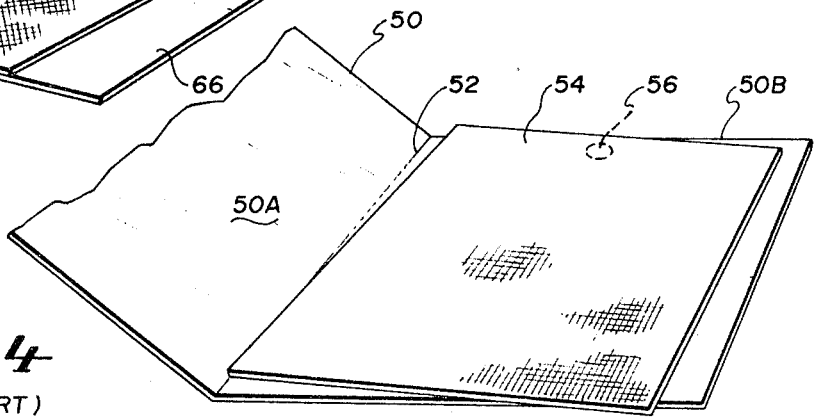
FIG. 4 (PRIOR ART)
FIG. 4 shows a prior art newspaper insert.

FIG. 4 shows an example of one prior art type of newspaper insert for paper towel samples made by the first method discussed in the Background of the Invention. This type of newspaper advertising insert had a printed cover sheet 50 which was folded along fold line 52 to form a folder type cover having a front cover 50A and a back cover 50B. A precut individual paper towel sheet 54 was attached by glue spot 56 near the center top inside surface of back cover 50B.

The newspaper insert of the present invention and the method illustrated in FIG. 1 have significant advantages over the prior art newspaper insert shown in FIG. 4. First, the method of the present invention is entirely automated and can produce advertising inserts at high speed, while the prior art insert was produced by hand and involved gluing of individual sheets 54 with glue spots 56. The prior art method, therefore, was much slower and extremely limited as far as number of inserts produced.

Second, the entirely automated method of FIG. 1 produces advertising inserts at significantly less cost. When hundreds of thousands or millions of advertising inserts are being produced, even a small percentage in cost can be significant. With the present invention, however, the cost savings of the present invention may be on the order of forty to fifty dollars per thousand inserts produced.

Third, the present invention results in precisely aligned edges of the sample sheet with respect to the cover sheets. This presents a neat and attractive advertising insert to the customer. On the other hand, the prior art inserts, which are produced by hand, can result in skewing or misalignment of the insert with respect to the cover. This is illustrated in somewhat exaggerated form in FIG. 4.

Figure 5:
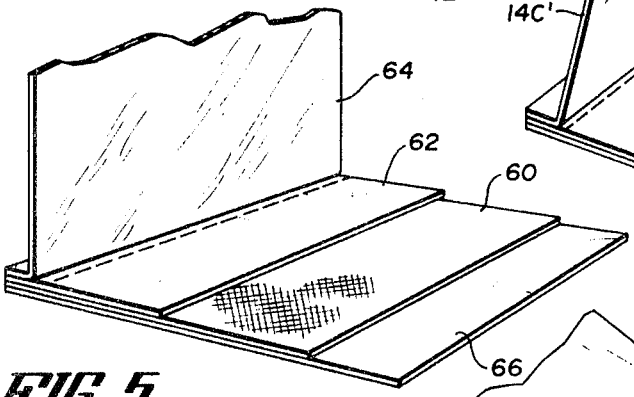
FIG. 5 illustrates an advertising insert of the present invention containing samples of two different thin absorbent paper products.

FIG. 5 shows another embodiment of the present invention, which is a newspaper advertising insert having sample sheets 60 and 62 of two different materials, such as paper towel and toilet tissue. Sample sheets 60 and 62 are contained between cover sheets 64 and 66. The advertising insert of FIG. 5 is produced by the method illustrated in FIG. 1, except that a second sample strip is overlayed on the first sample strip, and an additional strip of glue must be applied to the top surface of the second sample strip so that all four layers (ribbons) are bonded together.

Figure 6:
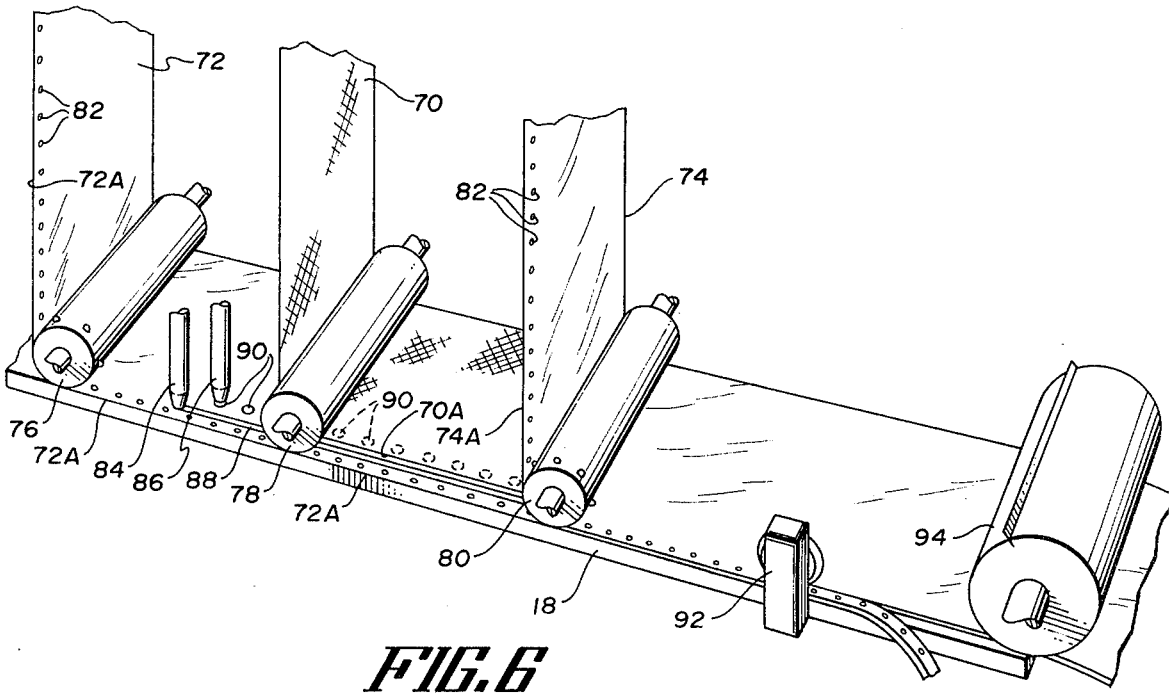
FIG. 6 illustrates another embodiment of the method of the present invention for producing an advertising insert for newspapers.

FIG. 6 illustrates another embodiment of the present invention which has been used to produce advertising inserts for newspapers. In the embodiment shown in FIG. 6 a sample ribbon 70 and first and second cover ribbons 72 and 74 are overlayed along a common path.

First cover ribbon 72 is supplied under roller 76, sample ribbon 70 is supplied under roller 78, and second cover ribbon 74 is supplied under roller 80. As in the embodiment shown in FIG. 1, cover sheets 72 and 74 have line holes 82 along their first stub edges 72A and 74A.

The method illustrated in FIG. 6 differs from the method illustrated in FIG. 1 in two important respects. First, in FIG. 6 two glue nozzles 84 and 86 apply glue to the top surface of cover strip 72. Nozzle 84 applies a thin strip 88 of glue, while nozzle 86 applies individual spots of glue 90. Glue strip 88 is located closer to line holes 82 and first edge 72A of strip 72 than are the individual spots 90.

Sample ribbon 70 is supplied under roller 78 and is bonded to ribbon 72 by glue spots 90. The stub edge 70A of strip 70 is spaced from the stub edge 72A of cover ribbon 72 so that it does not contact glue strip 88. Instead, glue strip 88 bonds together first cover ribbon 72 and second cover ribbon 74 when second cover ribbon 74 passes under roll 80. As a result, ribbons 72 and 74 are bonded securely to one another, while sample ribbon 70 is secured only to cover ribbon 72 and only at selective spots 90.

The second difference between the method illustrated in FIG. 6 and the method of FIG. 1 is that no perforation of the ribbons is required. With the embodiment shown in FIG. 6, perforation is not necessary, since the resulting sample sheet can be removed by pulling it with respect to the cover sheets, thereby pulling it from the adhesive spots 90.

Trimmer 92 trims off the line hole bearing portion of the first and second ribbons, while leaving the glued strip 88 intact. Knife assembly 94 then cuts the bonded strips transversely to form individual newspaper inserts.

Figure 7:
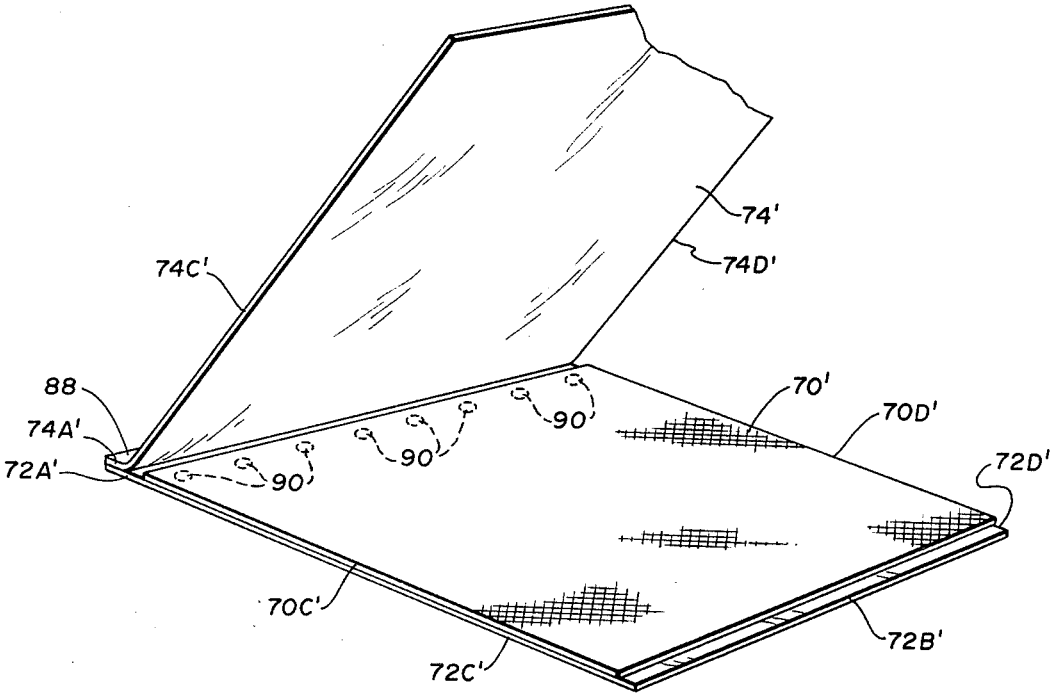
FIG. 7 shows an advertising insert produced by the method of FIG. 6.

FIG. 7 shows a newspaper advertising insert produced by the method of FIG. 6. Sample sheet 70' is attached to cover sheet 72' by adhesive spots 90. Cover sheet 74' is attached to cover sheet 72' by adhesive strip 88, which extends parallel to the finished first edges 74A' and 72A' of sheets 74' and 72', respectively.

In one successful embodiment, glue spots 90 were "hot glue" spots positioned approximately one inch apart and about five-eights inch from edges 72A' and 74A'. In this successful embodiment, sample sheet 70' is a paper towel sample sheet from a roll having first dimensions of eleven inches by eleven inches. Sheets 72' and 74' were twelve inches from their trimmed stub edge to their outer edges. The distance between edges 74C' and 74D' and between 72C' and 72D' was eleven inches. As in the case of the previous embodiments of the present invention, the third and fourth edges of the sample sheet and of the cover sheets were formed by cutting transversely with knife assembly 94. As a result, the edges are aligned.

With the embodiment shown in FIG. 7, it has been found that a sample such as a paper towel, can be easily removed by pulling the sheet and removing sheet 70' from adhesive spots 90. As a result, the method shown in FIG. 6 avoids the need for perforations. In addition, the width of sample strip 70' can be slightly less than the width required for strip 10 of FIG. 1 in order to produce the same effective width of sample sheet (tissue). This is because in the embodiment shown in FIG. 1, a portion of the sample strip 10 is bonded to the first and second corner strips 12 and 14 and is not removed when the sample sheet is torn along perforation 40.

Figure 8:
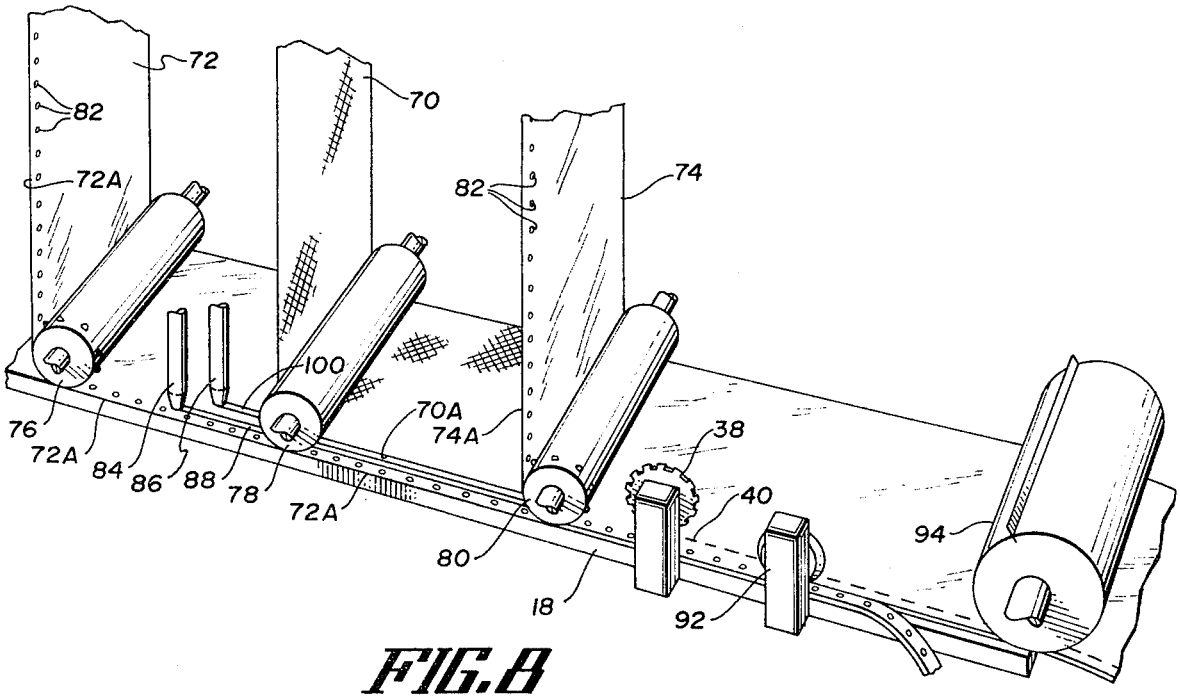
FIG. 8 illustrates still another embodiment of the method of the present invention for producing an advertising insert for newspapers.

FIG. 8 shows still another successful embodiment of the present invention, which is generally similar to the embodiment shown in FIG. 6, and similar reference numerals are used to designate similar elements. One difference between the embodiment shown in FIG. 8, and the embodiment shown in FIG. 6 is that glue nozzle 86 applies a strip of glue 100 rather than the glue spots 90 provided in the embodiment shown in FIG. 6. The other difference is that a perforation wheel 38 (similar to the one shown in FIG. 1) is used in the embodiment shown in FIG. 8.

In one successful embodiment of the method illustrated in FIG. 8, sample ribbon 70 was an unperforated paper towel ribbon having a width of eleven and one-quarter inches. The cover ribbons 72 and 74 were 60# or 70# paper, either uncoated or coated. Ribbons 70, 72, and 74 were supplied from rolls of material.

In this preferred embodiment, "cold glue" strips 88 and 100 were applied by glue nozzles 84 and 86, respectively, and had a width of about one-sixteenth inch. Glue strips 88 and 100 were located approximately one-quarter inch from the finished first (stub) edges of ribbons 72 and 70, respectively. Glue strip 88 glued cover ribbons 72 and 74 together, while glue strip 100 glued sample ribbon 70 to cover ribbon 72. Perforation 40 produced by perforation wheel 38 was positioned about five-eights inch from the final stub edge of cover ribbons 72 and 74. The finished width of the insert was about twelve inches from the stub edge of cover ribbons 72 and 74 to their outer edges, and about eleven inches from their third edges to their fourth edges.

In conclusion, the present invention permits high speed and low cost production of advertising inserts for newspapers which contain a sample sheet or sheets of a thin absorbent paper tissue such as paper towel, paper tissue, or toilet tissue. The advertising insert of the present invention can be produced at lower cost than the prior art types of insert, can be produced at higher rates, and results in a more attractive insert because the sample sheet is aligned with its edges parallel to the edges of the cover sheets.

Although the present invention has been described with reference to preferred embodiments, others will recognize that changes may be made in form and detail without departing from the spirit and scope of the invention.

What is claimed is:

1. A method of producing an advertising insert for newspapers, the advertising insert including a sample sheet of a thin, absorbent paper tissue attached along a stub edge between front and back cover sheets, the method comprising:

supplying, along a path, a first cover ribbon of printed cover paper, a second cover ribbon of printed cover paper, and a sample ribbon of the thin absorbent paper tissue with their stub edges closely spaced and essentially parallel to one another; wherein the first and second cover ribbons have line holes at longitudinally spaced locations proximate their stub edges;

bonding the first and second cover ribbons and the sample ribbon longitudinally proximate their stub edges with the sample ribbon between the first and second cover ribbons so that each ribbon is attached to at least one of the other ribbons; and wherein bonding the first and second cover ribbons and the sample ribbon longitudinally proximate their stub edges is at a location spaced from the stub edges of the first and second cover ribbons such that the line holes are located between the stub edges of the first and second cover ribbons and the bonding location;

cutting the bonded ribbons longitudinally to remove line hole bearing portions of the first and second cover ribbons proximate the stub edges; and cutting the bonded ribbon transversely to produce an insert having first and second cover sheets with a sample sheet of the thin absorbent paper tissue attached therebetween at the stub edge, and having transverse cut edges of the first and second cover sheets and the sample sheet being essentially aligned.

2. The method of claim 1 wherein bonding the first and second cover ribbons and the sample ribbon comprises:

applying a strip of adhesive to the first cover ribbon longitudinally proximate its stub edge;

applying a strip of adhesive to the sample ribbon longitudinally proximate its stub edge; and applying force along the stub edges to bond the sample ribbon to the first cover ribbon and the second cover ribbon to the sample ribbon.

3. The method of claim 2 and further comprising:

perforating the bonded ribbon longitudinally along a path parallel to the stub edge after bonding and prior to cutting the bonded ribbon transversely to permit removal of the sample sheet along a perforation.

4. The method of claim 1 wherein the sample ribbon is without transverse perforations.

5. The method of claim 1 wherein the thin absorbent paper tissue is provided on a first roll and has a width greater than the width of the sample ribbon, and wherein supplying the sample ribbon comprises:

longitudinally slitting the thin absorbent paper tissue from the first roll to produce the sample ribbon;

rewinding the sample ribbon onto a second roll; and supplying the sample ribbon from the second roll.

6. The method of claim 1 wherein the stub edge of the sample ribbon is parallel to and spaced from the stub edge of the first and second cover strips by a predetermined distance.

7. The method of claim 6 wherein bonding the first and second cover ribbons and the first sample ribbon comprises:

applying a strip of adhesive to the first cover ribbon longitudinally proximate the stub edge within the predetermined distance of the stuc edge of the first cover ribbon;

applying adhesive at spaced locations longitudinally on the first cover ribbon, the adhesive locations being spaced from the stub edge of the first cover ribbon by greater than the predetermined distance; and bonding the sample ribbon to the second cover ribbon with the adhesive at spaced locations; and bonding the first cover ribbon to the second cover sheet with the strip of adhesive.

8. The method of claim 6 wherein bonding the first and second cover ribbons and the first sample ribbon comprises:

applying a first longitudinal strip of adhesive to the first cover ribbon proximate the stub edge within the predetermined distance of the stub edge of the first cover ribbon;

applying a second longitudinal strip of adhesive to the first cover ribbon, the second longitudinal strip being spaced from the stub edge of the first cover ribbon by greater than the predetermined distance; and bonding the sample ribbon to the second cover ribbon with the second longitudinal strip of adhesive; and bonding the first cover ribbon to the second cover sheet with the first longitudinal strip of adhesive.

9. The method of claim 8 and further comprising:

perforating the bonded ribbon longitudinally along a path parallel to the stub edge after bonding and prior to cutting the bonded ribbon transversely to permit removal of the sample sheet along a perforation, the perforation being on an opposite side of the second longitudinal strip of adhesive from the stub edges.

* * * * *